US006601322B2

(12) United States Patent
Hsiao

(10) Patent No.: US 6,601,322 B2
(45) Date of Patent: Aug. 5, 2003

(54) SPIKE ANCHORING DEVICE FOR DETACHABLY SECURING A SPIKE TO A SOLE OF A GOLF SHOE

(76) Inventor: Hsing-Nan Hsiao, No. 26, Hsing-Lung 3rd Lane, Chia-Hou Rd., Ta-Tung Tsun, Wai-Pu Hsiang, Taichung Hsien (TW)

( * ) Notice: Subject to any disclaimer, the term of this patent is extended or adjusted under 35 U.S.C. 154(b) by 29 days.

(21) Appl. No.: 10/010,853

(22) Filed: Dec. 10, 2001

(65) Prior Publication Data

US 2003/0106245 A1 Jun. 12, 2003

(51) Int. Cl.[7] ..... A43B 5/00; A43C 15/02; A43C 15/16

(52) U.S. Cl. ..... 36/134; 36/67 D; 36/67 A; 36/62

(58) Field of Search ..... 36/134, 67 D, 36/62, 64, 59 B, 67 R, 67 A, 59 R, 67 B

(56) References Cited

U.S. PATENT DOCUMENTS 4,035,934 A * 7/1977 Hrivnak ..... 36/67 D
6,260,292 B1 * 7/2001 Swedick et al. ..... 36/134
6,434,860 B1 * 8/2002 Turos ..... 36/134
6,510,625 B2 * 1/2003 Sato et al. ..... 36/67 D
6,513,266 B1 * 2/2003 Ijiri ..... 36/134

* cited by examiner

*Primary Examiner*—Anthony D. Stashick
(74) *Attorney, Agent, or Firm*—Brooks & Kushman P.C.

(57) ABSTRACT

A spike anchoring device is disposed in a sole of a golf shoe for detachably securing a spike to the sole, and includes a clamping member of a one-piece construction received in an accommodation space in the sole. The clamping member includes front and rear jaws connected to and urged toward each other so as to snugly retain a shank of the spike, and front and rear arms respectively extending from the front and rear jaws and urged toward each other so that when a spindle of an actuator extends into the accommodation space to pry into a clearance between the arms, the jaws will be moved away from each other so as to release the shank of the spike, thereby permitting the shank to be pulled out of the device.

10 Claims, 9 Drawing Sheets

SPIKE ANCHORING DEVICE FOR DETACHABLY SECURING A SPIKE TO A SOLE OF A GOLF SHOE

BACKGROUND OF THE INVENTION

1. Field of the Invention

This invention relates to a golf shoe accessory, more particularly to a spike anchoring device for detachably securing a spike to the sole of the golf shoe.

2. Description of the Related Art

Referring to FIG. 1, a conventional golf shoe 1 is shown to include a sole 101 with a plurality of seat members 2 formed therein and each having a screw hole 201. A spike 3 includes a threaded shank 301 capable of engaging threadedly the screw hole 201 in each seat member 2, an abutting plate 302 for abutting against the sole 101 and having two opposite positioning holes 3021 formed in a bottom side thereof, and a spike pin 303 extending downwardly from the abutting plate 302. When detaching the spike 3 from the sole 101 for replacement, it is required to use a specific tool 4, which includes two longitudinally oriented pins 401 formed on an end of a shaft 402 thereof to be inserted respectively into the holes 3021, and a handle 403 for rotating the threaded shank 301 of the spike 3 to screw out the screw hole 201. Therefore, the engagement and disengagement operations of the spikes 3 are inconvenient to conduct. Furthermore, these operations cannot be achieved once the specific tool 4 is lost. Moreover, in this threaded engagement, the spikes 3 are liable to loosen from the sole 101 when the golf shoe 1 is in use.

SUMMARY OF THE INVENTION

The object of the present invention is to provide a spike anchoring device which is used for detachably securing a spike to the sole of a golf shoe and which facilitates replacement of the spike.

According to this invention, the spike anchoring device includes a chamber which is disposed in a sole of a golf shoe, and which has ceiling and floor surfaces that are spaced apart from each other by a height in an upright direction to define an accommodation space. A first inner surrounding wall is disposed in the sole, and extends in the upright direction to communicate a treading surface of the sole with the floor surface so as to confine an insert hole communicated with the accommodation space. The insert hole is capable of receiving a shank of a spike such that an upper portion of the shank extends into the accommodation space, and such that a spike body of the spike is disposed downwardly and outwardly of the treading surface. A second inner surrounding wall is disposed in the sole, and extends in the upright direction to communicate the treading surface with the floor surface so as to confine an access bore which is apart from the insert hole in a radial direction relative to a line parallel to the upright direction. The access bore extends in the upright direction to communicate with the accommodation space, and is capable of receiving and permitting a spindle of an actuator to extend into the accommodation space. A clamping member of a one-piece construction is disposed in the accommodation space, and includes front and rear jaws respectively with front proximate and distal ends, and rear proximate and distal ends relative to the access bore. The front and rear jaws are spaced apart from and are urged toward each other by a first biasing action in a transverse direction relative to the upright direction. When the upper portion of the shank is forced via the insert hole to extend into the accommodation space, the surrounding wall of the shank provides resistance against the first biasing action, thereby snugly retaining the shank between the front and rear jaws. An interconnecting portion is disposed to interconnect the front and rear distal ends of the front and rear jaws. The clamping member further includes front and rear arms which respectively extend from the front and rear proximate ends, and which terminate at front and rear lip portions disposed over the access bore. The front and rear lip portions are spaced apart from each other by a clearance, and are urged toward each other by a second biasing action in the transverse direction. As such, when the spindle of the actuator is inserted in the access bore and extends into the accommodation space to pry into the clearance against the second biasing action, movement of the front and rear lip portions away from each other will pull the front jaw to move away from the rear jaw and release the surrounding wall of the shank, thereby permitting the shank to be pulled out of the insert hole.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
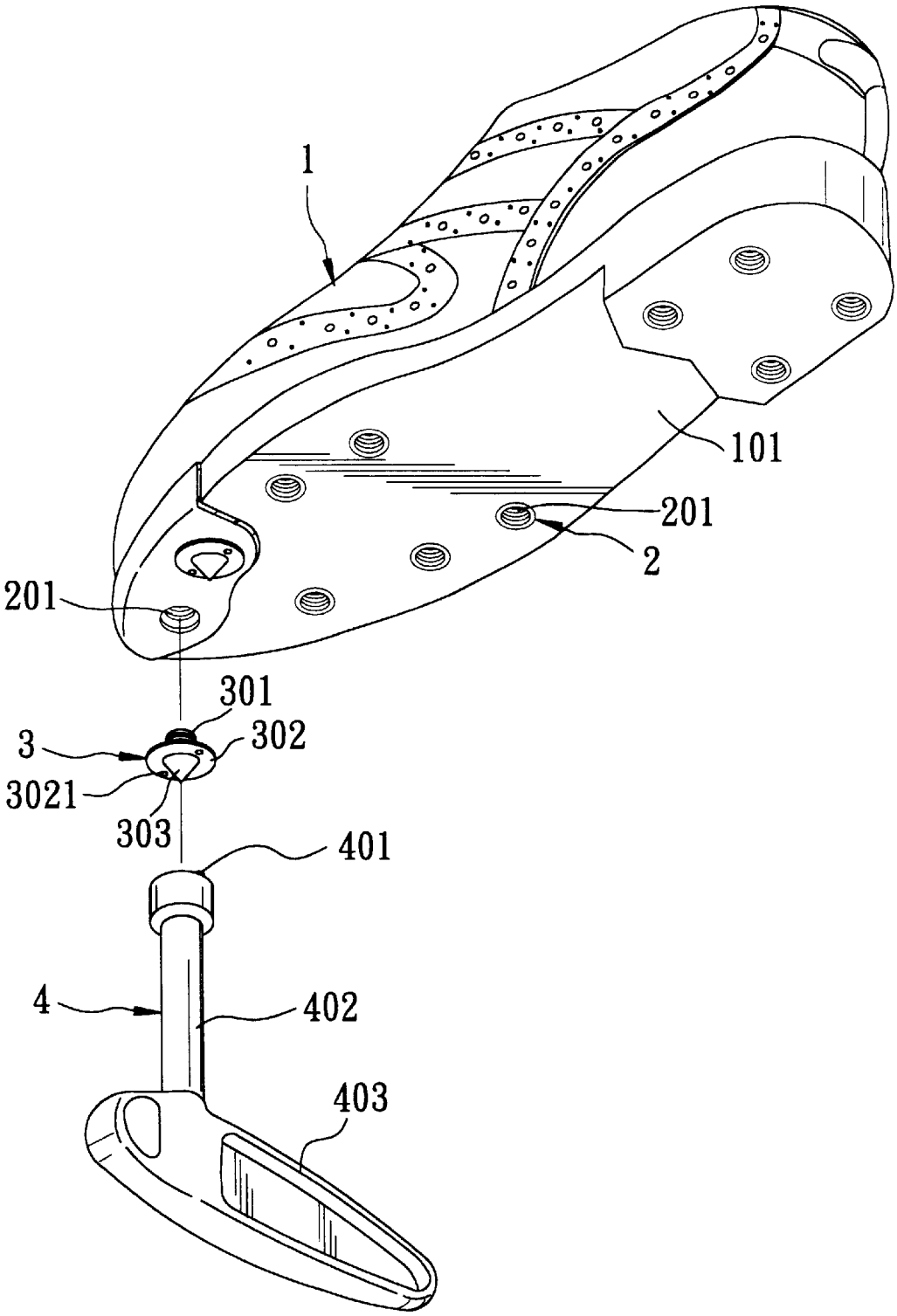
FIG. 1 PRIOR ART
FIG. 1 is an exploded perspective view of a conventional golf shoe and a spike replacement tool.
Figure 2:
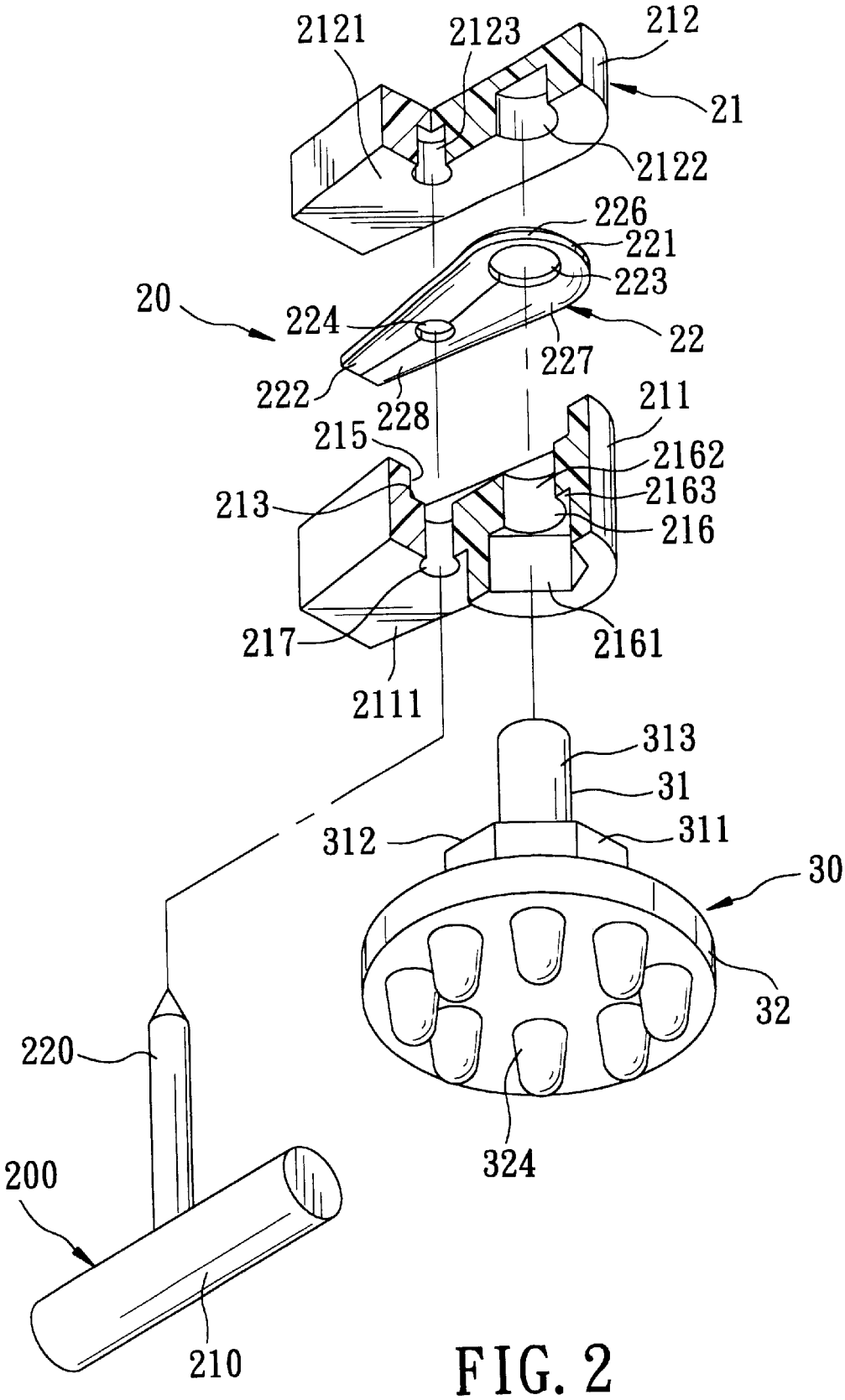
FIG. 2 is a partly cutaway exploded perspective view of a preferred embodiment of a spike anchoring device and a spike according to this invention.
Figure 3:
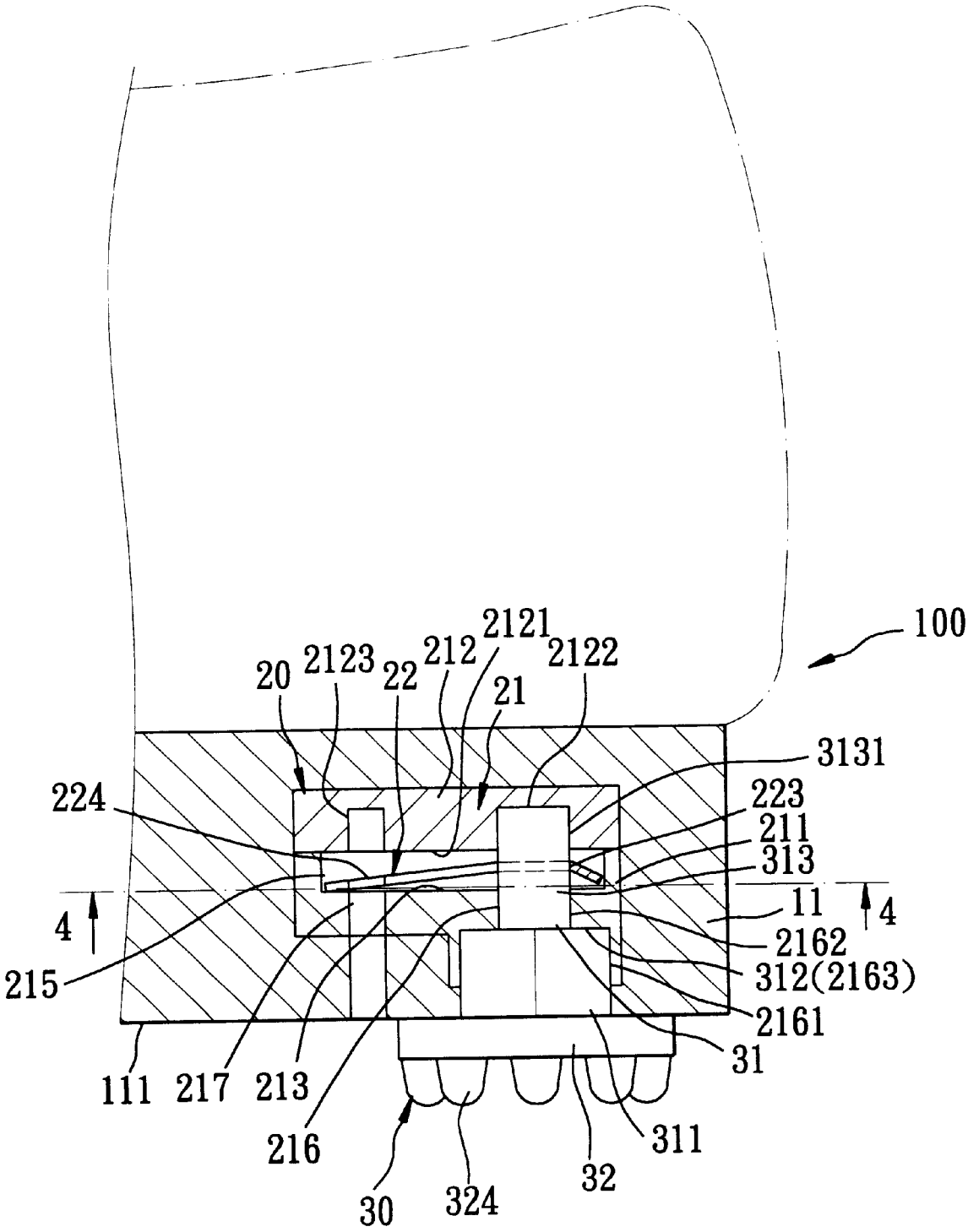
FIG. 3 is a partially sectioned view showing the spike anchoring device and the spike mounted on a sole of a golf shoe.
Figure 7:
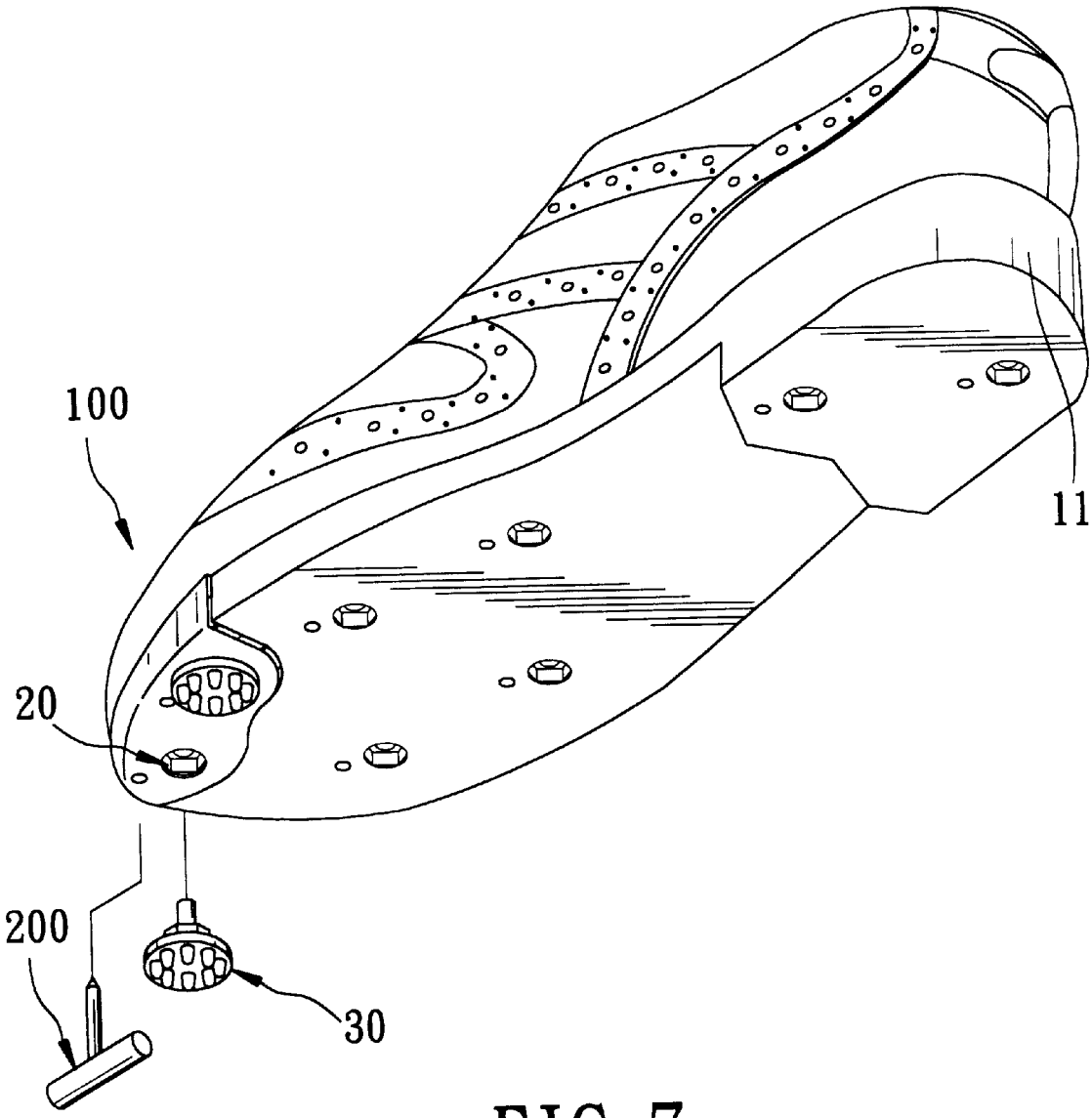
FIG. 7 is a perspective view showing the spike anchoring device and the spike when mounted on the golf shoe.

Referring to FIGS. 2, 3 and 7, the preferred embodiment of the spike anchoring device 20 according to the present invention is shown to detachably secure a spike 30 to the sole 11 of a golf shoe 100. The sole 11 has a treading surface 111 used to contact the ground. The spike 30 includes a spike body 32 which is formed with a plurality of spike pins 324 to increase traction force of the treading surface 111 of the sole 11, and a shank 31 which includes a lower portion 311 of a hexagonal shape that is connected to the spike body 32 and an upper portion 313 that extends from the lower portion 311 in an upright direction and distal to the spike body 32.

A shoulder 312 is formed between the upper and lower portions 313,311. The upper portion 313 has a surrounding wall 3131 which surrounds a line parallel to the upright direction.

The spike anchoring device 20 is shown to comprise a seat member 21 and a clamping member 22. The seat member 21 is embedded in the sole 11, and includes upper and lower seat segments 212,211 which are superimposed upon each other in the upright direction. The lower and upper seat segments 211,212 respectively have a top end surface 213 and a bottom end surface 2121 which are spaced apart from each other in the upright direction to respectively form floor and ceiling surfaces of a chamber with an accommodation space 215.

A first inner surrounding wall 216 is formed in the seat member 21, and extends from a lower end surface 2111 of the lower seat segment 211 in the upright direction through the accommodation space 215 so as to confine an insert hole with a larger lower hole part 2161, a smaller upper hole part 2162 and a shoulder 2163 therebetween. The lower hole part 2161 has a hexagonal shape so that when the shank 31 is inserted into the insert hole while the shoulders 312,2163 engage each other, the lower portion 311 is in a spline engagement with the lower hole part 2161 so as to prevent rotation of the spike 30 relative to the seat member 21. In addition, the upper portion 313 of the shank 31 extends into the accommodation space 215, and the spike body 32 is disposed downwardly and outwardly of the treading surface 111 of the sole 11.

A second inner surrounding wall 217 is formed in the seat member 21, and extends from the lower end surface 2111 in the upright direction through the accommodation space 215 so as to confine an access bore which is apart from the insert hole in a radial direction relative to the line for receiving and permitting a spindle 220 of a T-shaped actuator 200 to extend into the accommodation space 215. Moreover, each of the first and second inner surrounding walls 216,217 further extends upwardly from the bottom end surface 2121 of the upper seat segment 212 to form a recess 2122,2123 in the upper seat segment 212 for accommodating a respective one of the upper portion 313 of the shank 31 and the spindle 220 of the actuator 200 which passes through the accommodation space 215.

Figure 4:
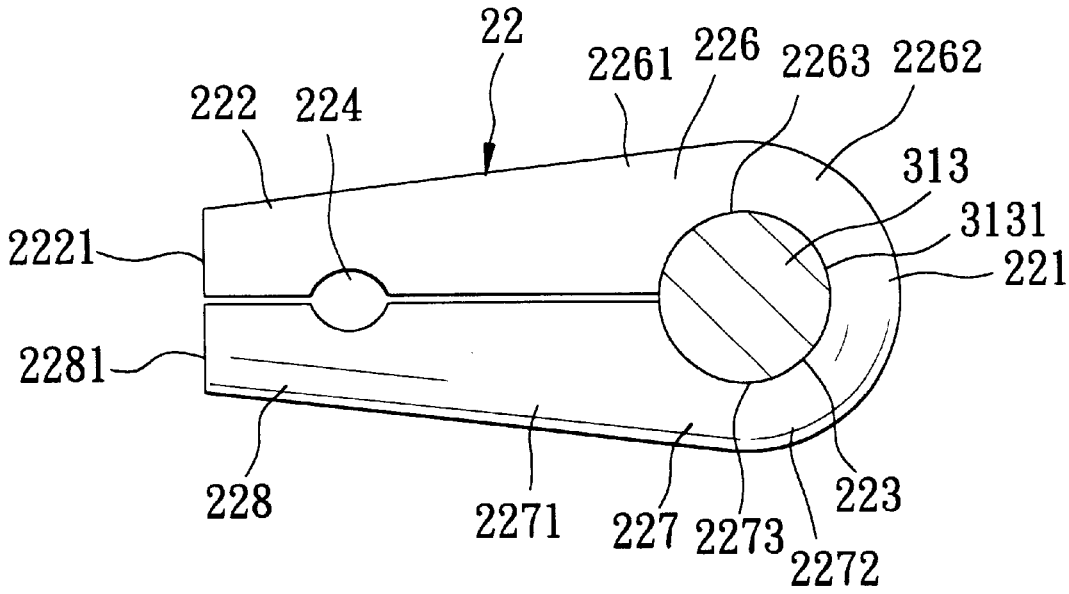
FIG. 4 is a partly cross-sectional view of a clamping member shown in FIG. 3, taken along lines 4—4 thereof.

With reference to FIGS. 3 and 4, the clamping member 22 has a one-piece construction which is made spring steel or the like, and is disposed in the accommodation space 215. The clamping member 22 includes front and rear jaws 226,227 which respectively have front proximate and distal ends 2261,2262, and rear proximate and distal ends 2271, 2272 relative to the access bore of the second inner surrounding wall 217. The front and rear jaws 226,227 are spaced apart from and are configured to be urged toward each other by a first biasing action in a transverse direction relative to the upright direction. The front and rear jaws 226,227 are formed respectively with first front and rear notch wall surfaces 2263, 2273 which are disposed opposite to each other in the transverse direction and which are in a curved shape to confine a retaining hole 223 surrounding the line. An interconnecting portion 221 is disposed to interconnect the front and rear distal ends 2262,2272 of the front and rear jaws 226,227. Thus, when the upper portion 313 of the shank 31 is forced via the insert hole of the first inner surrounding wall 216 to extend into the accommodation space 215 and the recess 2122, the surrounding wall 3131 of the shank 31 provides resistance against the first biasing action, thereby snugly retaining the shank 31 in the retaining hole 223. Preferably, the retaining hole 223 converges gradually from a lower hole end toward an upper hole end thereof.

Front and rear arms 222,228 respectively extend from the front and rear proximate ends 2261,2271 of the front and rear jaws 226,227, and terminate at front and rear lip portions 2221,2281 which are disposed over the access bore of the second inner surrounding wall 217. The front and rear arms 222,228 are formed with second front and rear notch wall surfaces which confine a curved clearance 224, and are configured to be urged toward each other by a second biasing action in the transverse direction.

Figure 6:
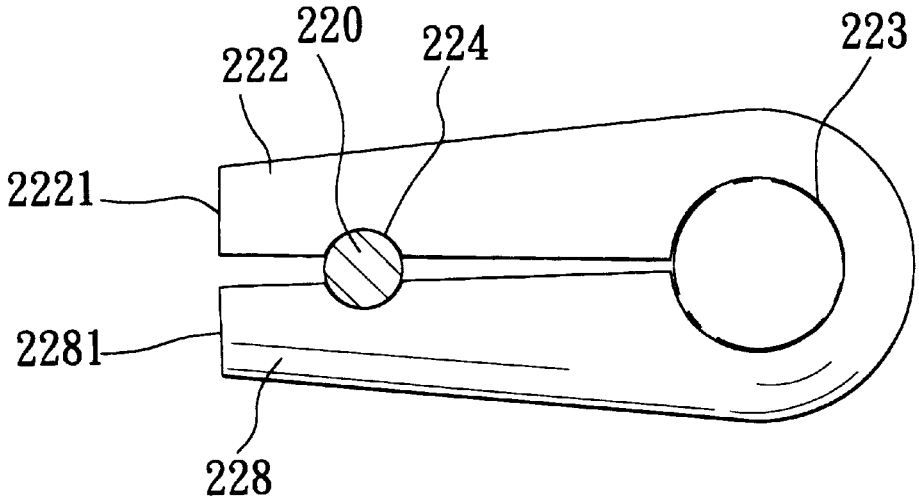
FIG. 6 is partly cross-sectional view of the clamping member shown in FIG. 5, taken along lines 6—6 thereof.
Figure 5:
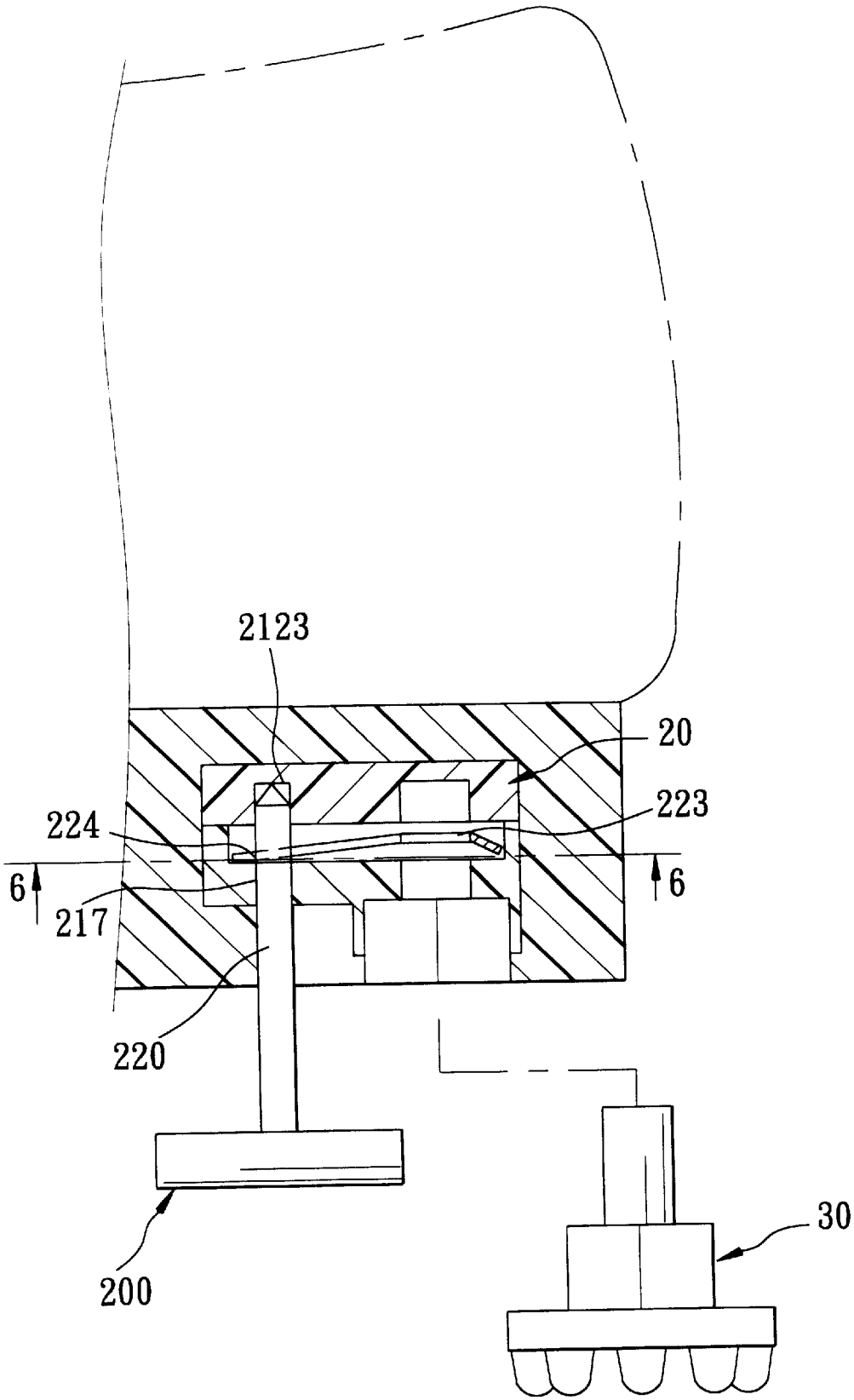
FIG. 5 is a partially sectioned view showing the spike when detached from the spike anchoring member.

As such, referring to FIGS. 5 and 6, when the spindle 220 of the actuator 200 is inserted in the access bore and extends into the recess 2123 through the accommodation space 215 to pry into the clearance 224 against the second biasing action of the front and rear arms 222,228, movement of the front and rear lip portions 2221,2281 away from each other will pull the front jaw 226 to move away from the rear jaw 227 and release the shank 31, thereby permitting the shank 31 to be pulled out of the insert hole of the first inner surrounding wall 216.

As illustrated, by inserting the spindle 220 into the clearance 224, detachment of the shank 31 from the seat member 20 is facilitated so that the replacement operation of the spike 30 is convenient to conduct. Moreover, a general tool with a tapered operating tip end can serve as the actuator 200 and is readily available.

Figure 8:
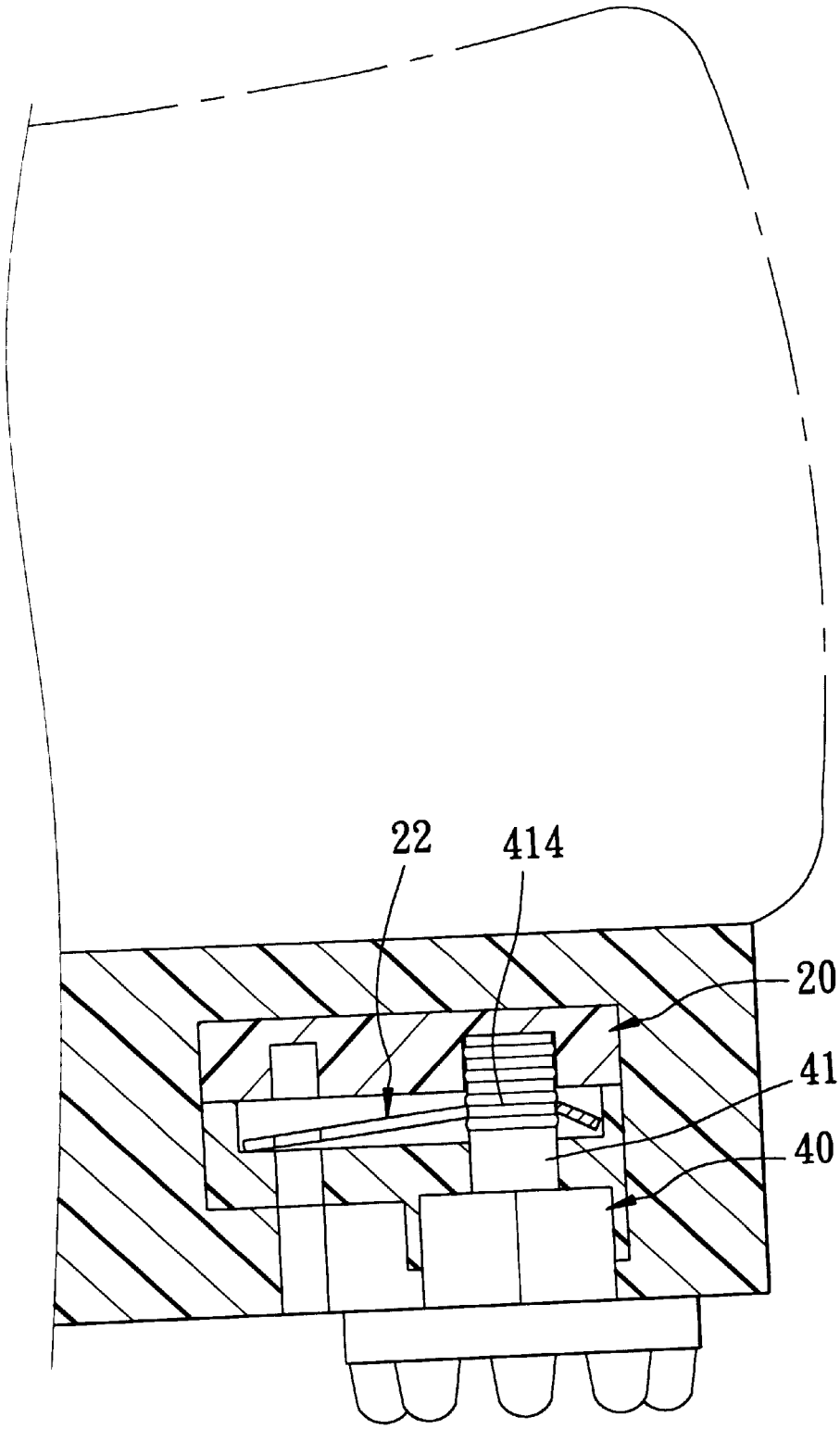
FIG. 8 is a partially sectioned view showing the spike anchoring device and the spike of another embodiment when mounted on a sole of a golf shoe.
Figure 9:
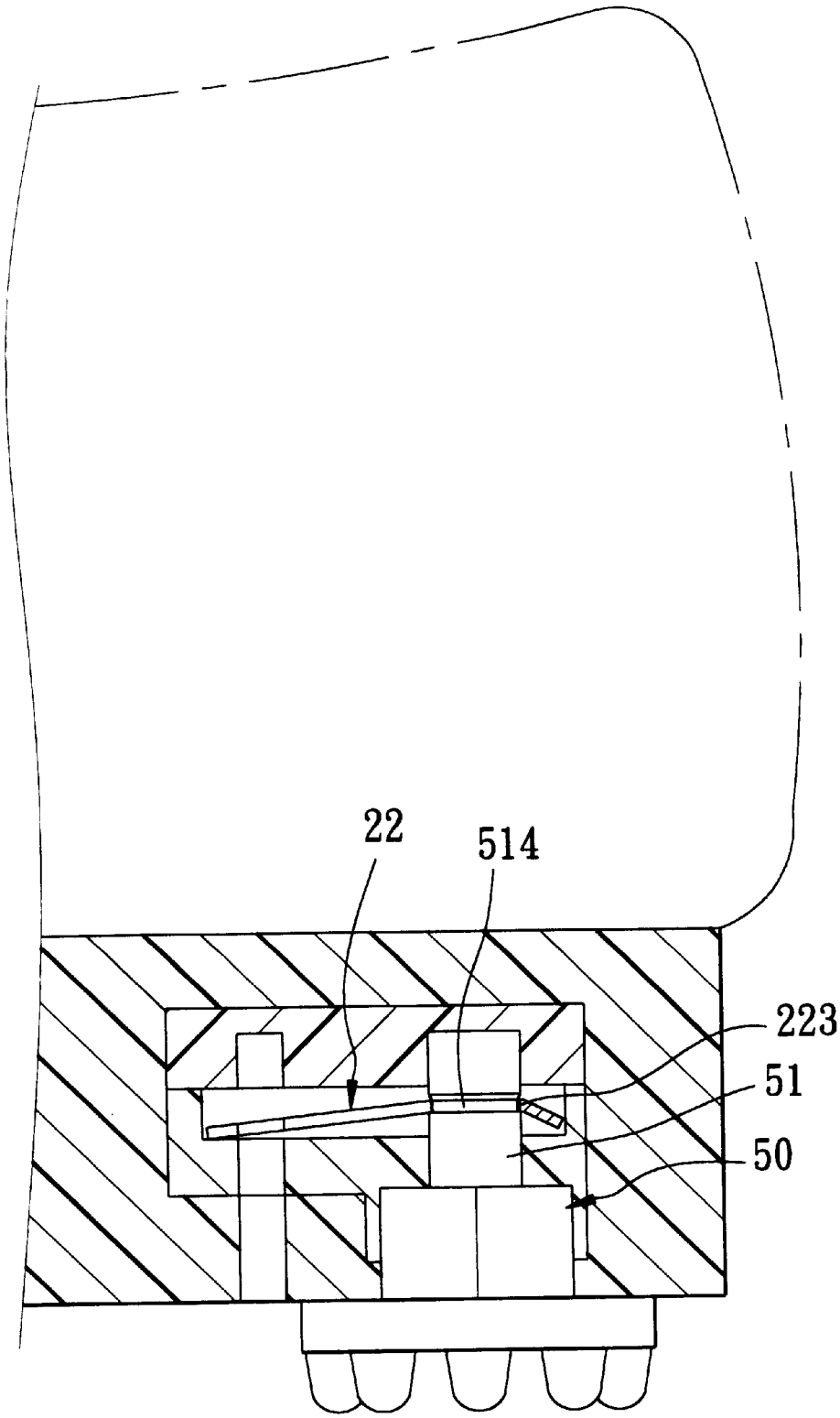
FIG. 9 is a partially sectioned view showing the spike anchoring device and the spike of still another embodiment when mounted on a sole of a golf shoe.
Figure 10:
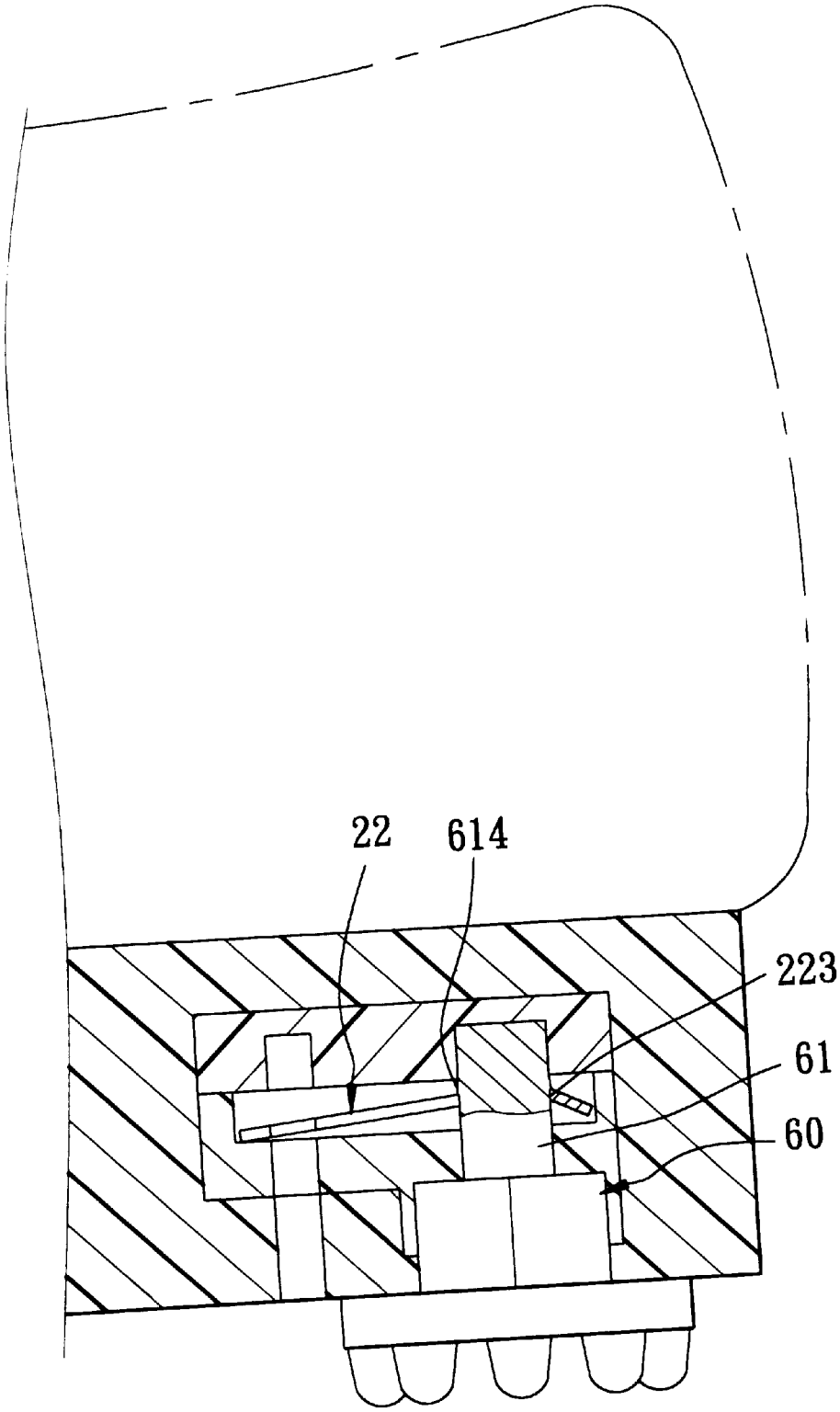
FIG. 10 is a partially sectioned view showing the spike anchoring device and the spike of a further embodiment when mounted on a sole of a golf shoe.

To reinforce the retaining engagement between a shank 41 of a spike 40 and the retaining hole 223 of the clamping member 22, referring to FIG. 8, the surrounding wall of the shank 41 is formed with annular friction protrusions 414. Referring to FIG. 9, another spike 50 has an annular groove 514 which is formed in the surrounding wall of the shank 51 thereof and which is snugly retained between the front and rear jaws of the clamping member 22. Alternatively, referring to FIG. 10, yet another spike 60 has an annular abutting rib 614 which is formed on the surrounding wall of the shank 61 thereof to abut against the periphery of the retaining hole 223.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A spike anchoring device used for detachably securing a spike to a sole of a golf shoe which has a treading surface used to contact the ground, the spike including a spike body configured to increase traction force of the treading surface of the sole, and a shank having a lower portion connected to the spike body and an upper portion extending from the lower portion in an upright direction and distal to the spike body, the upper portion having a surrounding wall surrounding a line parallel to the upright direction, said spike anchoring device comprising:

a chamber adapted to be disposed in the sole, and including ceiling and floor surfaces spaced apart from each other by a height in the upright direction to define an accommodation space;

a first inner surrounding wall adapted to be disposed in the sole, and extending in the upright direction to communicate the treading surface with said floor surface so as to confine an insert hole communicated with said accommodation space, said insert hole being adapted to receive the shank such that the upper portion of the shank extends into said accommodation space and such that the spike body is disposed downwardly and outwardly of the treading surface;

a second inner surrounding wall adapted to be disposed in the sole, and extending in the upright direction to communicate the treading surface with said floor surface so as to confine an access bore which is apart from said insert hole in a radial direction relative to the line, said access bore extending in the upright direction to communicate with said accommodation space, said access bore being adapted to receive and permit a spindle of an actuator to extend into said accommodation space; and a clamping member of a one-piece construction disposed in said accommodation space, and including front and rear jaws respectively having front proximate and distal ends, and rear proximate and distal ends relative to said access bore, said front and rear jaws being spaced apart from and configured to be urged toward each other by a first biasing action in a transverse direction relative to the upright direction such that when the upper portion of the shank is forced via said insert hole to extend into said accommodation space, the surrounding wall of the shank provides resistance against the first biasing action, thereby snugly retaining the shank between said front and rear jaws, an interconnecting portion disposed to interconnect said front and rear distal ends of said front and rear jaws, and front and rear arms respectively extending from said front and rear proximate ends, and terminating at front and rear lip portions which are disposed over said access bore, which are spaced apart from each other by a clearance, and which are configured to be urged toward each other by a second biasing action in the transverse direction such that when the spindle is inserted in said access bore and extends into said accommodation space to pry into said clearance against the second biasing action, movement of said front and rear lip portions away from each other will pull said front jaw to move away from said rear jaw and release the surrounding wall of the shank, thereby permitting the shank to be pulled out of said insert hole.

2. The spike anchoring device of claim 1, further comprising a seat member adapted to be embedded in the sole, and having a bottom wall surface adapted to be disposed proximate to the treading surface, each of said first and second inner surrounding walls being formed in said seat member and extending from said bottom wall surface in the upright direction, said chamber being formed in said seat member, said floor surface being disposed to be opposite to said bottom wall surface in the upright direction.

3. The spike anchoring device of claim 2, wherein said seat member includes upper and lower seat segments which are superimposed upon each other in the upright direction, said lower seat segment having a lower end surface formed as said bottom wall surface, and a top end surface formed as said floor surface of said chamber, said upper seat segment having a bottom end surface formed as said ceiling surface of said chamber so as to cooperate with said top end surface of said upper seat segment to confine said accommodation space therebetween.

4. The spike anchoring device of claim 3, wherein each of said first and second inner surrounding walls further extends from said bottom end surface of said upper seat segment upwardly in the upright direction to form a recess which is communicated with said accommodation space and which is adapted for respectively accommodating the upper portion of the shank and the spindle of the actuator.

5. The spike anchoring device of claim 1, wherein said front and rear jaws are formed respectively with first front and rear notch wall surfaces which are disposed opposite to each other in the transverse direction to confine a retaining hole that surrounds the line and which are in a curved shape so as to snugly retain the surrounding wall of the shank, said front and rear arms being formed respectively with second front and rear notch wall surfaces which confine said clearance.

6. The spike anchoring device of claim 5, wherein said retaining hole has upper and lower hole ends respectively distal and proximate to the treading surface in the line, and converges gradually from said lower hole end toward said upper hole end.

7. A spike and anchoring assembly adapted to be detachably secured to a sole of a golf shoe which has a treading surface used to contact the ground, comprising:

a spike including a spike body configured to increase traction force of the treading surface of the sole, and a shank having a lower portion connected to said spike body and an upper portion extending from the lower portion in an upright direction and distal to said spike body, said upper portion having a surrounding wall surrounding a line parallel to the upright direction; and a spike anchoring device including:

a chamber adapted to be disposed in the sole, and including ceiling and floor surfaces spaced apart from each other by a height in the upright direction to define an accommodation space, a first inner surrounding wall adapted to be disposed in the sole, and extending in the upright direction to communicate the treading surface with said floor surface so as to confine an insert hole communicated with said accommodation space, said insert hole receiving said shank such that said upper portion of said shank extends into said accommodation space and such that said spike body is disposed downwardly and outwardly of the treading surface, a second inner surrounding wall adapted to be disposed in the sole, and extending in the upright direction to communicate the treading surface with said floor surface so as to confine an access bore which is apart from said insert hole in a radial direction relative to the line, said access bore extending in the upright direction to communicate with said accommodation space, said access bore being adapted to receive and permit a spindle of an actuator to extend into said accommodation space, and a clamping member of a one-piece construction disposed in said accommodation space, and including front and rear jaws respectively having front proximate and distal ends, and rear proximate and distal ends relative to said access bore, said front and rear jaws being spaced apart from and configured to be urged toward each other by a first biasing action in a transverse direction relative to the upright direction such that when said upper portion of said shank is forced via said insert hole to extend into said accommodation space, said surrounding wall of said shank provides resistance against the first biasing action, thereby snugly retaining said shank between said front and rear jaws, an interconnecting portion disposed to interconnect said front and rear distal ends of said front and rear jaws, and front and rear arms respectively extending from said front and rear proximate ends, and terminating at front and rear lip portions which are disposed over said access bore, which are spaced apart from each other by a clearance, and which are configured to be urged toward each other by a second biasing action in the transverse direction such that when the spindle is inserted in said access bore and extends into said accommodation space to pry into said clearance against the second biasing action, movement of said front and rear lip portions away from each other will pull said front jaw to move away from said rear jaw and release said surrounding wall of said shank, thereby permitting said shank to be pulled out of said insert hole.

8. The assembly of claim 7, wherein said surrounding wall of said shank has an annular rib formed thereon.

9. The assembly of claim 7, wherein said surrounding wall of said shank has an annular groove formed therein and snugly retained between said front and rear jaws when said upper portion of said shank extends into said accommodation space.

10. The assembly of claim 7, wherein said spike and said insert hole are configured to be in a spline engagement with each other.

* * * * *